US009841183B2

(12) United States Patent
Ilin

(10) Patent No.: US 9,841,183 B2
(45) Date of Patent: Dec. 12, 2017

(54) ELECTRODE BOILER WITH ELECTRODES UNIT

(71) Applicant: No Eul Kim, Busan (KR)

(72) Inventor: Andrey Pavlovich Ilin, Moscow (RU)

(73) Assignee: No Eul Kim

( * ) Notice: Subject to any disclaimer, the term of this patent is extended or adjusted under 35 U.S.C. 154(b) by 336 days.

(21) Appl. No.: 14/650,213

(22) PCT Filed: Dec. 5, 2012

(86) PCT No.: PCT/IB2012/003083
§ 371 (c)(1),
(2) Date: Jun. 5, 2015

(87) PCT Pub. No.: WO2014/087190
PCT Pub. Date: Jun. 12, 2014

(65) Prior Publication Data
US 2015/0316253 A1 Nov. 5, 2015

(51) Int. Cl.
*F22B 1/30* (2006.01)
*H05B 3/60* (2006.01)
(Continued)

(52) U.S. Cl.
CPC ..... *F22B 1/30* (2013.01); *F24H 1/203* (2013.01); *F24H 9/0047* (2013.01);
(Continued)

(58) Field of Classification Search
None
See application file for complete search history.

(56) References Cited

U.S. PATENT DOCUMENTS 421,499 A * 2/1890 Hubinger ..... F22B 1/30 392/312
1,475,645 A * 11/1923 Meyer-Keller ..... F22B 1/30 392/326
(Continued)

FOREIGN PATENT DOCUMENTS

CA 1166296 A1 4/1984
CA 1244864 A1 11/1988
(Continued)

OTHER PUBLICATIONS

Japan Patent Office, Office Action, dated Aug. 2, 2016, issued in Japanese Patent Application No. 2015-546098.
(Continued)

*Primary Examiner* — Thor Campbell
(74) *Attorney, Agent, or Firm* — Klarquist Sparkman, LLP

(57) ABSTRACT

The invention relates to heat engineering, power engineering and the field of electric heating of liquids, water for instance; it can be used in circulation water heating systems and hot water supply, and as a universal device for diverse electric heaters. An object of the invention are to enhance the ease of fabrication, fabricability, and operability for block electrodes and electrode heating boilers on the whole, to increase the reliability of device both in static and dynamic modes ones. The invention meets an object of extended performance capabilities, versatility and flexibility of the device, potential diversification and enhancement of adaptability in solving particular problems. Moreover, the invention allows improvement of convection in water heating boilers and reduction of uniformity of sludge and rust deposition on electrodes thus increasing the heater effective performance time. The invention object comprises an improvement of protection against breakdowns between the electrodes as well, phase current load imbalance reduction, electrode
(Continued)

protection against non-uniform deformation during operation in dynamic conditions. It is also an object of the invention to extend i the range of constructional capacity control without design and dimensional changes. FIG. 2 provides a schematic of electrodes (1) arrangement on the basis (3) located on the inner case (2) side with electrodes (1) slightly deviating from the longitudinal symmetric axis of the case (2) and irregularly spaced on the basis, electrode longitudinal axes deviating from each other at small angles. (4)—outer electrode terminals (1).

28 Claims, 6 Drawing Sheets

(51) Int. Cl.

| | |
|---|---|
| ***H05B 3/02*** | (2006.01) |
| ***H05B 3/03*** | (2006.01) |
| ***F24H 1/20*** | (2006.01) |
| ***F24H 9/18*** | (2006.01) |
| ***F24H 9/00*** | (2006.01) |

(52) U.S. Cl.
CPC ..... *F24H 9/1818* (2013.01); *H05B 3/023* (2013.01); *H05B 3/03* (2013.01); *H05B 3/60* (2013.01); *F24H 2250/10* (2013.01)

(56) References Cited

U.S. PATENT DOCUMENTS

| | | | | | |
|---|---|---|---|---|---|
| 1,503,972 | A * | 8/1924 | Berg | F22B 1/303 | 392/322 |
| 1,522,188 | A * | 1/1925 | Hull | H05B 6/48 | 392/312 |
| 1,527,707 | A * | 2/1925 | Schneider | F22B 1/30 | 392/322 |
| 1,548,741 | A * | 8/1925 | Pou | F24H 1/105 | 392/323 |
| 2,050,607 | A * | 8/1936 | Hallman | F22B 1/30 | 392/331 |
| 2,162,462 | A * | 6/1939 | Reid | F24F 6/025 | 126/13 |
| 2,263,549 | A * | 11/1941 | Peyches | C03B 5/027 | 204/246 |
| 2,387,103 | A * | 10/1945 | Wicks | F22B 1/30 | 338/40 |
| 3,242,313 | A * | 3/1966 | Lamphier | F22B 1/30 | 392/325 |
| 3,246,276 | A * | 4/1966 | Miehe | H01C 10/02 | 338/80 |
| 3,313,920 | A | 4/1967 | Gallez | | |
| 3,520,979 | A * | 7/1970 | Penberthy | C03B 5/027 | 373/41 |
| 3,688,077 | A * | 8/1972 | Williams | F22B 1/303 | 392/331 |
| 3,761,679 | A * | 9/1973 | Dall | F22B 1/30 | 122/451 R |
| 3,931,530 | A | 1/1976 | Davis et al. | | |
| 4,036,716 | A * | 7/1977 | Hulthe | C02F 1/46104 | 204/196.05 |
| 4,121,090 | A | 10/1978 | Kuenzli | | |
| 4,169,558 | A | 10/1979 | Coates | | |
| 4,394,561 | A * | 7/1983 | Zerbel | F22B 1/30 | 261/142 |
| 4,423,310 | A * | 12/1983 | Zerbel | F22B 1/30 | 338/83 |
| 4,748,314 | A | 5/1988 | Desage | | |
| 4,812,618 | A | 3/1989 | Kunzli et al. | | |
| 4,952,779 | A * | 8/1990 | Eaton-Williams | F22B 1/30 | 392/322 |
| 5,384,888 | A | 1/1995 | Peng | | |
| 5,454,059 | A | 9/1995 | Regehr | | |
| 5,526,461 | A * | 6/1996 | Grieder | F22B 1/30 | 392/325 |
| 5,605,645 | A | 2/1997 | Brandstädter-Springer et al. | | |
| 5,940,578 | A | 8/1999 | Goddard | | |
| 6,072,937 | A | 6/2000 | Benade et al. | | |
| 6,243,535 | B1 | 6/2001 | Bochud | | |
| 6,263,156 | B1 * | 7/2001 | Ledoux | F22B 1/30 | 392/322 |
| 7,403,701 | B2 | 7/2008 | Choi et al. | | |
| 9,657,965 | B2 * | 5/2017 | Nolte | F24H 9/0047 | |
| 2008/0279539 | A1 | 11/2008 | Szpilski et al. | | |
| 2009/0226356 | A1 | 9/2009 | Bruck et al. | | |
| 2010/0322605 | A1 | 12/2010 | van Aken et al. | | |

FOREIGN PATENT DOCUMENTS

| | | | |
|---|---|---|---|
| CA | 2163932 | A1 | 6/1996 |
| CH | 405 524 | A | 1/1966 |
| CN | 1082683 | A | 2/1994 |
| CN | 2306395 | Y | 2/1999 |
| CN | 201145263 | Y | 11/2008 |
| CN | 101952654 | A | 1/2011 |
| CN | 102439358 | A | 5/2012 |
| DE | 886 503 | | 8/1953 |
| DE | 2434907 | A1 | 2/1975 |
| DE | 2514524 | A1 | 10/1975 |
| DE | 2456665 | A1 | 8/1976 |
| DE | 2644355 | A1 | 3/1978 |
| DE | 2732683 | A1 | 2/1979 |
| EP | 0 207 329 | A1 | 1/1987 |
| FR | 784 573 | A | 7/1935 |
| FR | 2587449 | A1 | 3/1987 |
| FR | 2593890 | A1 | 8/1987 |
| GB | 2178834 | A | 2/1987 |
| GB | 2183802 | A | 6/1987 |
| GB | 2190989 | A | 12/1987 |
| GB | 2444369 | A | 4/2008 |
| JP | 354590 | | 12/1945 |
| JP | 363872 | | 5/1950 |
| JP | 48-027332 | A | 4/1973 |
| JP | 6038501 | A | 2/1985 |
| JP | 60108602 | A | 6/1985 |
| JP | 61134503 | A | 6/1986 |
| JP | 4324001 | A | 11/1992 |
| JP | H06-300203 | | 10/1994 |
| JP | 8261689 | A | 10/1996 |
| JP | 2002317902 | A | 10/2002 |
| JP | 2003-338356 | | 11/2003 |
| KR | 20-0127296 | Y1 | 7/1998 |
| KR | 20010084150 | A | 9/2001 |
| KR | 20020013018 | A | 2/2002 |
| KR | 20030090894 | A | 12/2003 |
| KR | 20060093192 | A | 8/2006 |
| KR | 10-2011-0135172 | A | 12/2011 |
| KR | 101132125 | B1 | 4/2012 |
| RU | 2037088 | C1 | 6/1995 |
| RU | 2137029 | C1 | 9/1999 |
| RU | 12637 | U1 | 1/2000 |
| RU | 16419 | U1 | 12/2000 |
| RU | 2168875 | C1 | 6/2001 |
| RU | 2168876 | C1 | 6/2001 |
| RU | 2189541 | C2 | 9/2002 |
| RU | 2209367 | C1 | 7/2003 |
| RU | 2225569 | C2 | 3/2004 |
| RU | 43624 | U1 | 1/2005 |
| RU | 2324859 | C1 | 5/2008 |
| SU | 303475 | | 5/1971 |
| SU | 379995 | | 6/1973 |
| SU | 465521 | | 3/1975 |
| SU | 879184 | | 11/1981 |
| SU | 1064083 | A | 12/1983 |
| SU | 1174683 | A | 8/1985 |
| SU | 1250791 | A1 | 8/1986 |
| SU | 1333992 | A1 | 8/1987 |
| SU | 1638444 | A1 | 3/1991 |
| WO | WO 8301101 | A1 | 3/1983 |
| WO | WO 8302710 | A1 | 8/1983 |
| WO | WO 8800316 | A1 | 1/1988 |
| WO | WO 9013771 | A1 | 11/1990 |

(56) References Cited

FOREIGN PATENT DOCUMENTS

| | | | |
|---|---|---|---|
| WO | WO 9318338 | A1 | 9/1993 |
| WO | WO 9506399 | A1 | 3/1995 |
| WO | WO 9721057 | A1 | 6/1997 |
| WO | WO 9836215 | A1 | 8/1998 |
| WO | WO 9917056 | A1 | 4/1999 |
| WO | WO 0011914 | A1 | 3/2000 |
| WO | WO 0031467 | A1 | 6/2000 |
| WO | WO 0175360 | A1 | 10/2001 |
| WO | WO 2010/095954 | A2 | 8/2010 |

OTHER PUBLICATIONS

European Patent Office, Extended European Search Report, dated Jun. 21, 2016, issued in European Patent Application No. 12889526.5.

Korean Intellectual Property Office, Notice of Allowance, dated Sep. 3, 2015, issued in Korea Application No. 10-2015-7007478.

Japan Patent Office, Office Action, dated Mar. 21, 2017, issued in Japan Patent Application No. 2015-546098.

* cited by examiner

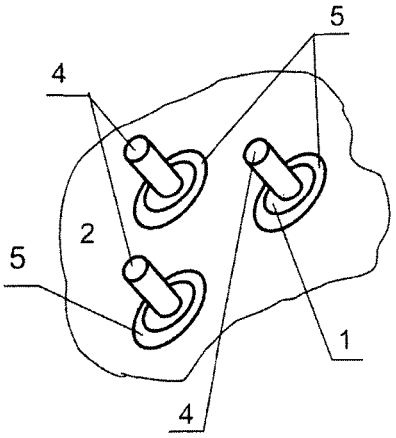
Fig. 29
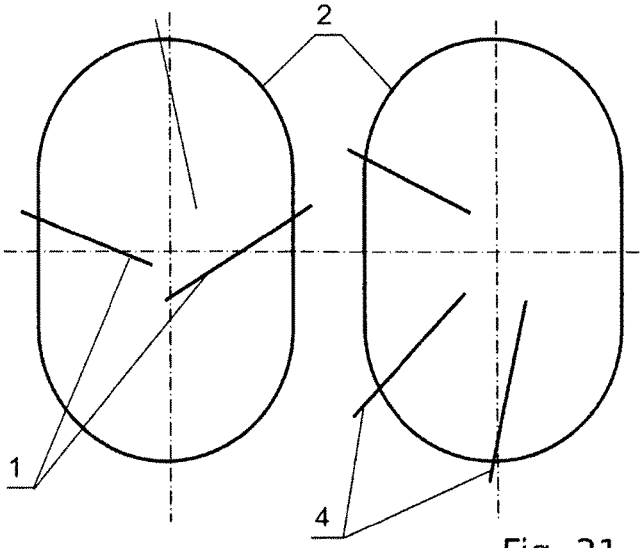
Fig. 30
Fig. 31
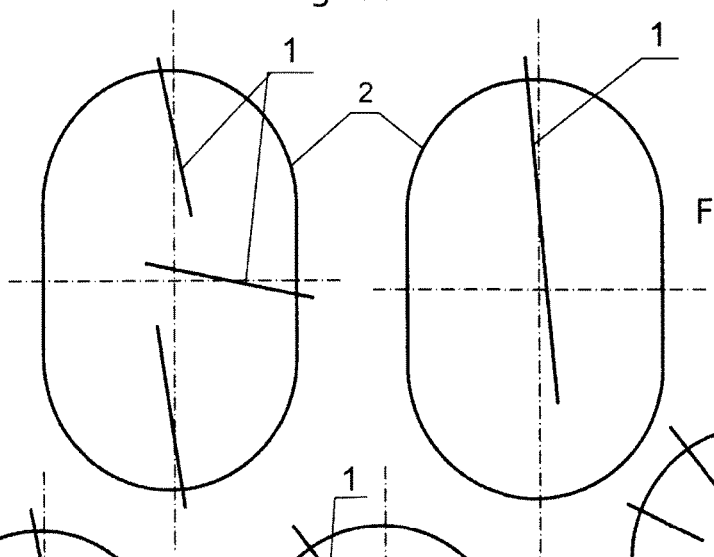
Fig.32
Fig. 33
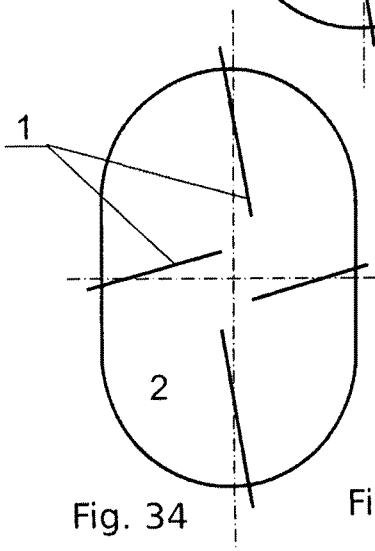
Fig. 34
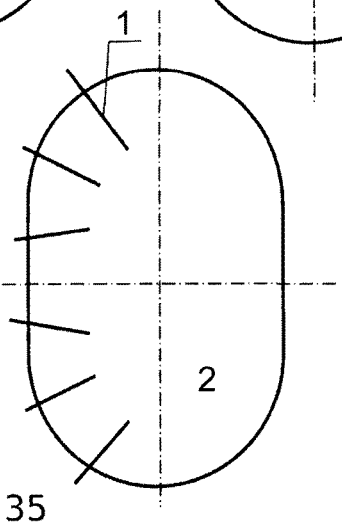
Fig. 35
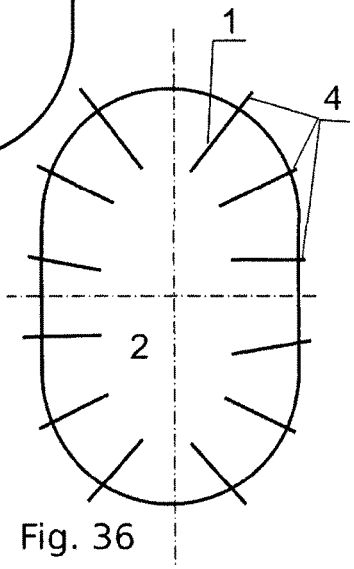
Fig. 36

ELECTRODE BOILER WITH ELECTRODES UNIT

FIELD OF THE INVENTION

The invention relates to heat engineering, power engineering and the field of electric heating of liquids, water for instance, steam generation, direct conversion of electric energy into heat energy; it can be used in circulation water heating systems, self-regulating liquid heaters for autonomous heating and hot water supply, mobile heating and hot water supply, and as a universal device for diverse electric heaters.

BACKGROUND OF THE INVENTION

Electrode water heating boilers are designed to provide hot water and steam at the expense of heat released by electric current (single- or three-phase one) directly flowing through water. Boilers are used for heating and hot water supply of production and residential spaces, in open as well as close heating systems. They are also used at industrial plants, agricultural plants, and any other facilities which manufacturing processes require hot water of 95 . . . 100 Celsius degrees. The simple design, high reliability, service life, efficiency, and fabricability in mass production as well as the ability of full automation and unattended operation present great advantages of electrode boilers. Their merits also include the potential relative easiness of maintenance of accurate temperature conditions in heated spaces and related to it saving of primary energy resources by consumers. Boilers became proliferated due to those reasons. They also can be used in parallel as hot water circulating pumps.

Among general disadvantages of electrode boilers the geometrically symmetric arrangement of electrodes inside the case, relative to each other, normally in parallel with the longitudinal axes and symmetry axes of the boiler case can be pointed out, which reduces considerably the fabricability of the devices, electrodes, complicates assembly, repair works, and cleaning as the latter can disturb the said symmetry. Besides, such a manner of electrode in-case fastening does not allow flexible purposive changing of convection conditions for liquid flows of different temperatures within the boiler thus impeding the mixing or separation subject to the boiler intended function. In addition, the strictly symmetric arrangement of electrodes creates favourable conditions for uniform deposition of iron oxidation products (rust Fe $(OH)_2$) and foreign particles suspended in the fluid (sludge), which reduces the overall efficiency of electrode system at a rather high rate.

Prior devices can be divided into groups as follows:

Group one. Electrode boilers are known with a true-vertical arrangement of electrodes which longitudinal axes normally either coincide with the boiler symmetry axes (at least for one electrode) or are true-parallel with the boiler symmetry axes (in this case longitudinal vertical ones) as defined in patents: DE2434907 (A1)—Geraet zur regelung der an eine ohmsche last abgegebenen elektrischen leistung 1975 Feb. 13; DE2514524 (A1)—Verfahren and vorrichtung zur verminderung oder vermeidung von krustenbildung an arbeitselektroden 1975 Oct. 9—three-phase boilers; as well as in devices: CA1166296 (A1)—Humidifier electrode shield, 1984 Apr. 24—with an increased current propagation path between the electrodes to reduce the probability of short-circuit by means of a baffle introduced between the electrodes; FR2587449 (A1)—Direct-heating boiler for producing steam and/or hot water, 1987 Mar. 20—with pointed ends of arranged vertically electrodes having their working ends thickened, parallel both with each other and longitudinal symmetry axes of the boiler, and KR101132125 (B1)—A reactor using electrode catalyst for high efficiency steam generator, 2012 Apr. 5—with electrodes fastened at the boiler bottom and arranged upwards in parallel and symmetrically with respect to the boiler. There are many modifications thereof and the following in particular:

a) The said group includes electrode boilers with their electrodes arranged vertically and having washers to maintain the parallel and vertical position of the electrodes in static conditions and all the heating temperature conditions inclusive of dynamic ones: WO9721057 (A1)—Boiler with fast steam generation, 1997 Jun. 12—with one electrode and one washer holding the electrode inside the boiler; U.S. Pat. No. 5,526,461 (A)—Evaporation vessel and electrode arrangement for an electrode evaporator having a dummy electrode 1996 Jun. 11—with one washer on the free ends of electrodes directed vertical-downwards. There are also devices as set forth in patents KR20060093192 (A)—Water heating apparatus using electrodes 2006 Aug. 24—several circumferentially arranged electrodes with one fixing washer; RU43624U1—Multiple electrode for electrode boiler Jun. 10, 2004, with one fixing washer superposed on the upper ends of symmetrically installed electrodes; U.S. Pat. No. 5,384,888 (A)—Vaporizer with electrode positioning 1995 Jan. 24—vertical parallel symmetrically arranged electrodes directed downwards along the symmetric axes, with a taper washer; U.S. Pat. No. 4,748,314 (A)—Device for the rapid vaporization of a liquid 1988 May 31—one electrode having on its free end a washer holding it in the boiler case; GB2444369 (A)—Electrode heater for liquid 2008 Jun. 4—with a sectional washer on vertical electrodes parallel with the boiler longitudinal axis; CN2306395 (Y)—Electrode device for generating steam 1999 Feb. 3—multi-sectional washers on parallel horizontally installed electrodes, which sections are equally spaced along the whole length of the electrodes;

b) Opposed arrangement of electrodes parallel with the boiler symmetric axes and each other, for example, WO8302710 (A1)—Current distribution for glass-melting furnaces 1983 Aug. 4—vertical upper and lower electrodes; RU2137029—Electrode boiler water heating, 26 Dec. 1997—opposed upper and lower electrodes offset with respect to each other in parallel with their longitudinal axes, arranged symmetrically in the case;

c) Boilers with electrodes installed in them in parallel and symmetrically to each other and boiler case can also be attributed to the group in question; electrodes having protective covers. Those devices are such as U.S. Pat. No. 6,263,156 (B1)—Recycling of air humidifier cylinders 2001 Jul. 17—vertical electrodes having protective covers; CN102439358 (A)—An electrode boiler 2012 May 2—with covers on vertically downward symmetrically arranged electrodes; U.S. Pat. No. 5,454,059 (A)—Evaporation control adaptor sleeve for vaporizer electrode 1995 Sep. 26—inclined conical cover on electrodes; U.S. Pat. No. 6,263,156 (B1)—Recycling of air humidifier cylinders 2001 Jul. 17—vertical electrodes having protective covers; P61134503 (A)—Electric type once-through boiler 1986 Jun. 21—protective covers on electrodes made as mating cylinders different in their diameters;

d) Various kinds of bushings superposed on round electrodes to improve the basis insulating properties, for example, in accordance with patent DE2732683 (A1)—Elektrodendampferzeuger 1979 Feb. 1—multiple electrode with bushings;

e) Devices having their electrodes of different heights can be ranked in the group of vertical symmetric electrodes, for instance, WO8301101 (A1)—Steam generator 1983 Mar. 31; RU1638444, steam generator, Apr. 4, 1989—with measuring electrodes of different heights; KR20020013018 (A)—Method and apparatus for controlling operation of electric steam boiler 2002 Feb. 20—active electrodes of different heights; DE2456665 (A1)—Elektrode fuer wasserstrahl-elektrodendampferzeuger 1976 Aug. 12—honeycomb active electrodes of different heights;

f) Electrodes are also used, which sections are non-circular, for example, truncated circle sections—KR101132125 (B1)—A reactor using electrode catalyst for high efficiency steam generator, 2012 Apr. 5; or sections in the form of any other geometric figures: U.S.2008279539 (A1)—Steam Generator Comprising a Swirling Device, 2008 Nov. 13—vertical electrodes of trapezoidal section, parallel with the longitudinal axis; CN101952654 (A)—Segmented rapid heating of fluid, 2011 Jan. 19—sectional plate electrodes; KR20030090894 (A)—Simple steam generator, 2003 Dec. 1—grooved plate electrodes.

Group two. Used electrodes in the shape of entirely different geometric figures.

a) Cylindrical coaxial electrodes: RU2168875—electrode for electrode liquid heater, 28 Dec. 1999; RU2168876—electrode for electrode water heater, 28 Dec. 1999—multilayer electrodes; similar to the above U.S. Pat. No. 4,812,618 (A)—Electrode boiler and an insulator therefor, 1989 Mar. 14—electrode with heat-conducting electric insulator; RU12637U1—electrode liquid heater, 4 Aug. 1999—electrodes in the form of hollow cylinders, symmetric in their cross-sections, equal in angles circular sections in the form of regularly alternating electroconductive and non-conductive sections; RU16419U1—electrode liquid heater and electrode (alternatives), 29 Feb. 2000—coaxial electrodes one of which is a cylindrical case accommodating the internal electrode so that the longitudinal axes of the case and electrode coincide; RU2189541 electrode liquid heater, 11 Apr. 2000—coaxial electrodes; KR20010084150 (A)—Electric boiler 2001 Sep. 6—slotted coaxial cylinders; JP8261689 (A)—Preventing method of generation of extraneous matter in water storage tank and waterstorage tank with executing device of said method 1996 Oct. 11—coaxial electrodes; U.S.2009226356 (A1)—Device and Method for Evaporating a Reactant, 2006 Oct. 2—horizontally arranged coaxial cylinders; CA2163932 (A1)—Method and apparatus for preventing the development of scale deposits in a water tank 1996 Jun. 2—concentric coaxial electrodes; GB2183802 (A)—Device for the fast generation of steam vapor 1987 Jun. 10—the electrodes are in the form of coaxial bowls with angled walls but being arranged along the boiler symmetric axis and symmetric themselves; WO0011914 (A1)—On-demand direct electrical resistance heating system and method thereof for heating liquid, 2000 Mar. 2—concentric electrodes arranged symmetrically with respect to each other; RU2209367—Electric boiler, 22 Nov. 2001—coaxial perforated electrodes arranged in aligning;

b) Bent, twisted, spiral electrodes having sections deviating from one direction, for instance, SU303475 Steam generator, 2 Sep. 1968—twisted electrode; SU379995—screw electrode, 1973 Apr. 20; WO8800316 (A1)—Steam generator for analytical instruments, 1988 Jan. 14—a combination of electrode helical section and vertical sections directed downwards; SU465521—Electric steam generator,—an electrode in the form of a straight spiral totally symmetric with respect to the boiler vertical symmetry axis; WO9318338 (A1)—A water tank for heating water preferably in a vending machine, 1993 Sep. 16—an electrode in the form of an inclined spiral with an inclined section but with its turns arranged symmetrically with respect to the boiler longitudinal vertical axis; WO0175360 (A1)—Household steam generator apparatus, 2001 Oct. 11—a coiled electrode; RU2324859—Electric steam generator, 4 Dec. 2006—electrode in the form of a symmetric spiral with central vertical terminal; WO9917056 (A1)—Process for restoring the level of water in boilers of steam generating machines 1999 Apr. 8—bent by 90 degrees electrode, and CN1082683 (A)—Efficient method for producing steam and seven kinds of thermal electric appliance of efficient steam 1994 Feb. 23; WO0031467 (A1)—Device for instantaneously producing steam 2000 Jun. 2—a combination of horizontal and vertical electrodes; WO9506399 (A1)—Heating element 1995 Mar. 2—vertical U-electrode; FR2593890 (A1)—Improved electric steam generator with water jets 1987 Aug. 7—one bent electrode angled with respect to the case longitudinal axis; WO9013771 (A1)—Steam generator 1990 Nov. 15, WO9836215 (A1)—Steam generator 1998 Aug. 20—horizontal U-electrodes;

c) Electrodes of other shapes, for example, SU1174683—Electric liquid heater, 27 Jul. 1983—one of the electrodes designed to be the case concurrently is made in the form of de Laval nozzle; SU879184—Electrode water heater, 30 Jan. 1980—piston-type electrode with a cone.

Group three. Inclined fastening of electrodes inside the case or partially inclined sections of electrodes:

a) Cone electrodes, for instance, as defined in patents: RU1064083—Electrode heater, 19 May 1982; RU1250791—Electrode heater, 14 Mar. 1985—electrode in the form of a symmetric inverse cone symmetrically arranged inside the case; RU1333992—Electrode heater, 1 Aug. 1985—the central electrode in the form of cone, directed downwards; U.S. Pat. No. 5,940,578 (A)—Water evaporation apparatus 1999 Aug. 17—angled walls of a chamber accommodating a symmetrically arranged electrode; U.S. Pat. No. 6,072,937 (A)—Steam generator 2000 Jun. 6—cone electrode, its longitudinal axis coinciding with the boiler vertical axis;

b) Inclined electrodes RU2037088—Three-phase current electric water heater, 30 Jun. 1992—plate trapezoidal inclined electrodes but arranged symmetrically with respect to the case symmetric axes; GB2178834 (A)—Steam generator 1987 Feb. 18—flat electrodes converging upwards but arranged true-symmetrically with respect to the boiler vertical longitudinal axis; GB2190989 (A)—Electrically heated steam generator 1987 Dec. 2—bent-down auxiliary surfaces; DE2644355 (A1)—Elektrodampferzeuger 1978 Mar.

30—inclined symmetric entry of electrodes but the electrodes are not inclined themselves and meet the boiler symmetry; JP4324001 (A)—Power generation plant 1992 Nov. 13—symmetric electrodes arranged along the cone generatrix; JP60038501 (A)—Electric type steam generator 1985 Feb. 28—inclined sections of vertical electrodes; JP60108602 (A)—Electric type steam generator 1985 Jun. 14—conical parts of cylindrical electrodes;

c) Other types of inclined components, for example, CA1244864 (A1)—Electrode configuration for a high voltage electrode boiler 1988 Nov. 15—inclined channels for heated liquid; JP2002317902 (A)—Nozzle assembly for electrode type electric boiler 2002 Oct. 31—tilted nozzle; CN201145263 (Y)—Electrical heating device of water 2008 Nov. 5—rotating plate electrodes; RU2225569—Steam generator, 30 Aug. 2001—branching electrode, but at the same time symmetrically arranged inside the case and forming symmetrically arranged branching sections.

BRIEF SUMMARY OF INVENTION CONCEPT

An object of the invention is to enhance the ease of fabrication, fabricability, and operability for multiple electrodes and electrode heating boilers on the whole. The invention also aims to improve the design reliability for the device in question, its protection against assembling inaccuracies, to bate requirements to the accuracy of installation of electrodes inside the case and their orientation against each other inclusive of various operating conditions, i.e., both static and dynamic ones. Besides, the invention seeks to increase the live of device, its service life period, maintainability and reparability. In addition, the invention meets an object of extended performance capabilities, versatility and flexibility of the device, potential diversification and enhancement of adaptability in solving particular problems. Moreover, the invention allows improvement of convection in water heating boilers and reduction of uniformity of sludge and rust deposition on electrodes thus increasing the heater effective performance time. The invention object comprises an improvement of protection against breakdowns between the electrodes as well, phase current load imbalance reduction, electrode protection against non-uniform deformation during operation in dynamic conditions. It is also an object of the invention to extend the range of constructional capacity control without design and dimensional changes.

To meet the above defined objects the electrode boiler with multiple electrode shall comprise a case, multiple electrode in the form of fastened inside the case rod electrodes, at least one; the electrodes shall be arranged non-symmetrically relative to the case symmetric axes and to each other; electrode longitudinal axes not coinciding with the case longitudinal axes, electrode longitudinal axes not coinciding with the case transverse axes and electrodes having external terminals brought out from the case outside. The multiple electrode shall also comprise at least one electrode basis.

Besides, the electrode boiler basis shall be implemented in the form of a plate, electrodes being fastened to the plate on one side of its first surface so that their longitudinal axes are arranged in the direction close to the normal one with respect to the first plate surface; electrode basis being fastened with the second surface on the inner side of the case.

The basis may be implemented of electrically insulating heat-resistant material.

The electrode basis may be implemented of metal.

The electrode basis is fastened with the second plane on the inner case side so that electrode ends are directed inside the internal boiler space.

The electrode basis is fastened with the second plane on the inner side of the upper half-case so that electrode ends are directed inside the internal boiler space downwards.

The electrode basis is fastened with the second plane on the inner side of the upper half-case so that free electrode ends are directed inside the internal boiler space laterally.

The electrode basis is fastened with its second plane on the inner side of the lower half-case so that free electrode ends are directed inside the internal boiler space upwards.

The electrode basis is fastened with one its plane on the outer case side so that electrode ends are directed inside the internal boiler space.

The electrode basis is fastened with the first plane on the outer side of the upper half-case so that electrode ends are directed inside the internal boiler space downwards.

The electrode basis is fastened with the first plane on the outer side of the upper half-case so that free electrode ends are directed inside the internal boiler space laterally.

The electrode basis is fastened with its first plane on the outer side of the lower half-case so that free electrode ends are directed inside the internal boiler space upwards.

Besides, the electrode boiler comprises insulating bushings implemented in the form of cylindrical tubes, superposed on the first electrode ends and connected to the basis until they rest in the basis; the bushings being constructively sunk, at least partially, in the basis; the height of bushings may vary.

The height of bushings may vary equally for all the electrodes.

The height of bushings may vary individually for each electrode.

Silicon joint sealant is applied between the basis and bushings at the interfaces.

In the electrode boiler with multiple electrode the boiler case is used as the electrode basis as well; bushings being inserted into through holes of the case so that they seal and insulate the case from the electrodes; electrode ends are brought through the bushings outside from the case, bushings being electric terminals.

Besides, in the electrode boiler with multiple electrode, free electrode ends are directed inside the boiler.

The electrode boiler with multiple electrode also comprises a fixing element implemented in the form of at least one washer having holes through which free electrode ends are brought.

Electrodes are pressed in the fixing element at least by a partial depth of the fixing element.

The electrode boiler with multiple electrode also comprises the following: chamfers made on the second electrode ends, which diameter corresponds to the diameter of washer holes; screw thread on the chamfers of second electrode ends; electrodes being screwed with their threaded parts into the washer holes, at least by the third part of washer thickness; nuts being fitted on the threaded electrode parts after the washer on the side of second electrode ends; the washer resting against electrode shoulders formed by the chamfers and being tightly pressed by nuts.

The electrode boiler with multiple electrode also comprises the following: pockets made on washer surfaces, their centre coinciding with the hole centres.

The pocket depth corresponds to the nut height; the nuts screwed on electrode ends being arranged in the pockets in flush.

The nuts are made of electric insulating material. The nuts are made of heat-resistant material. The nuts are made of metal.

There is also an electrode boiler with multiple electrode in which: expansion coefficient of washer material corresponds to the expansion coefficient of basis material; expansion coefficient of nut material corresponds to the expansion coefficient of washer material.

BRIEF DESCRIPTION OF DRAWINGS

FIG. 29 represents a view of case part from outside on the side of electrode terminals according to Embodiment 3.

FIGS. 30 . . . 36 illustrate sub-embodiments of Embodiment 3 of electrode arrangement without basis, directly inside the case; electrodes being arranged and oriented in various ways inside the case.

DESCRIPTION OF PREFERRED INVENTION EMBODIMENTS

Embodiment 1

Figure 1:
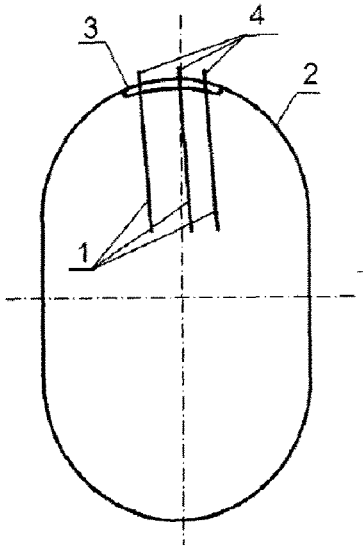
FIG. 1 shows a schematic of electrodes arrangement on the basis located on the inner case side with electrodes slightly deviating from the longitudinal symmetric axis of the case irregularly spaced on the basis and arranged inside the case according to Embodiment 1.

FIGS. 1 . . . 7, 14 . . . 28 represent a view of configuration of electrode boiler with multiple electrode according to Embodiment 1 of this invention.

Figure 2:
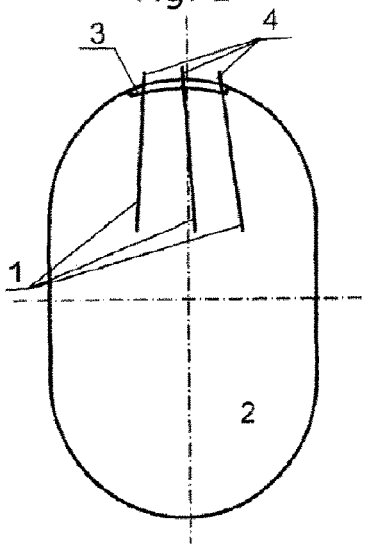
FIG. 2 provides a schematic of electrodes arrangement on the basis located on the inner case side with electrodes slightly deviating from the longitudinal symmetric axis of the case and irregularly spaced on the basis, electrode longitudinal axes deviating from each other at small angles.

As per Embodiment 1, electrodes 1 of the device, at least one or more electrodes are directed inside the case 2 downwards. In FIG. 1, electrodes 1 are directed straight down, the longitudinal axes of all the electrodes 1 slightly deviating from the longitudinal symmetric axis of case 2. Electrodes 1 if used more than one in number may be installed at different unequal distances to each other (FIG. 1). Longitudinal axes of part or of all electrodes 2 may also form nonzero angles against each other as shown in FIG. 2 accompanied by unequal distances between electrodes 1. Electrodes 1 are located at basis 3 which may be installed both inside case 2, as shown in FIGS. 1-2, 5-6, and outside—FIGS. 3-4. Each electrode 1 has terminal 4 running through basis 3 and case 2 to be connected to an electric power supply. Basis 3 may be implemented of electrically insulating heat-resistant material or of metal. In the last case electrodes 1 shall be installed on the basis thorough electrically insulating inserts 5 as shown in FIG. 7. The downward direction of electrodes 1 makes it possible to prevent entirely sludge deposition on basis 3 or section of case 2 between electrodes 1. This allows a considerable reduction of the probability of a breakdown between electrodes 1 along the surface of basis 3 or those of parts of case 2 between electrodes 1. Case 2 may be implemented either as fully enclosed split/with an opening cover as well as with drain tubes or as flowing, subject to the specific embodiment of the device.

Figure 3:
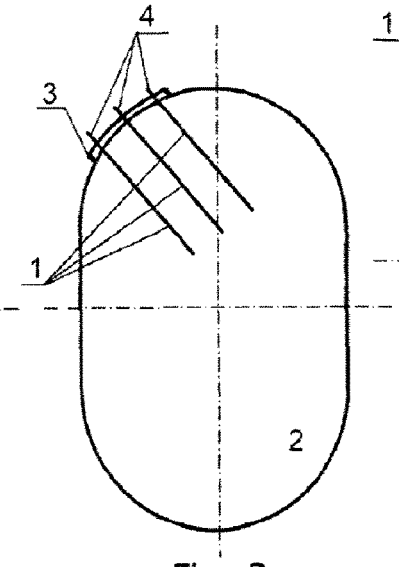
FIGS. 3 and 4 represent a schematic drawing of lateral entry of electrodes arranged downwards according to Embodiment 1, with relative orientation of electrode longitudinal axes similar to FIGS. 1 and 2 respectively. The electrode basis is arranged on the outer side of the case.
Figure 4:
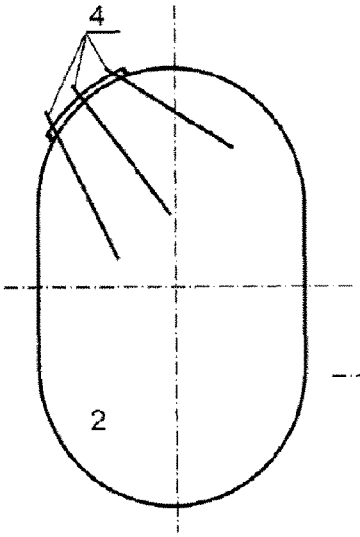

FIGS. 3-4 show an arrangement of electrodes with large angles of deviation from the longitudinal symmetry axis, i.e., entry of electrodes 1 downwards at the side of boiler case 2, this also accompanied by an irregular asymmetric arrangement of electrodes against each other, i.e., by different distances between the points of their entry to case 2 and different angles between longitudinal axes of electrodes 3, FIG. 4.

Figure 5:
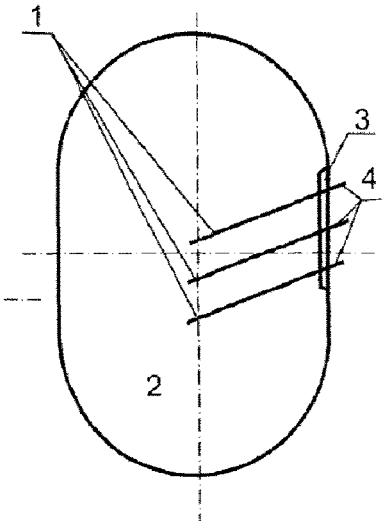
FIGS. 5 and 6 provide a schematic of a view of lateral entry of electrodes with their free ends arranged downwards according to Embodiment 1, with relative orientation of electrode longitudinal axes similar to FIGS. 1 and 2 respectively, with an in-case arrangement of electrode basis.
Figure 6:
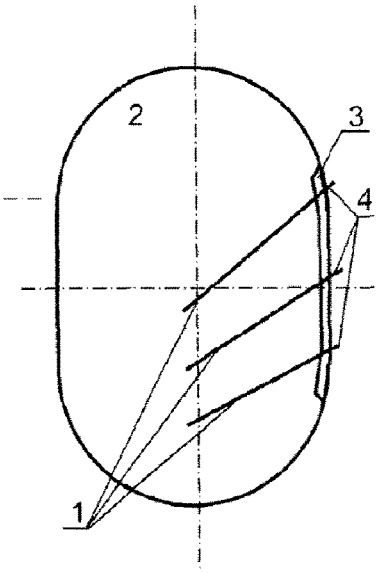
Figure 7:
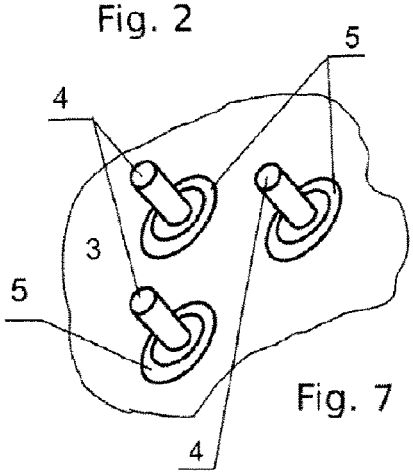
FIG. 7 shows a section of boiler case with an external view on outer electrode terminals with electrodes fastening in case the basis is implemented of metal.

FIGS. 5-6 illustrate the arrangement of electrodes 1 on the side face of case 2, their longitudinal axes deviating from the symmetric axes of the case and from each other (FIG. 6) with the direction of electrode ends into the lower part of case 2. In this case as well as in other sub-embodiments, basis 3 may be fixed both inside case 2 and outside it.

Figure 13:
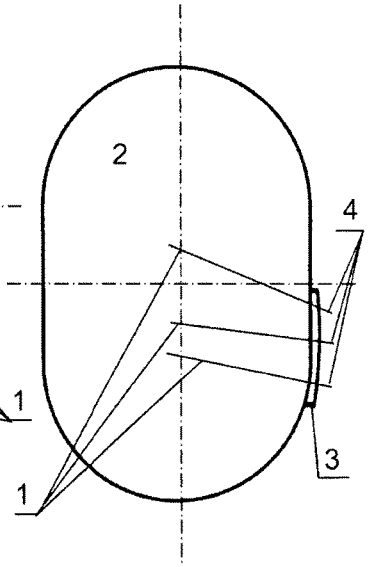
Figure 14:
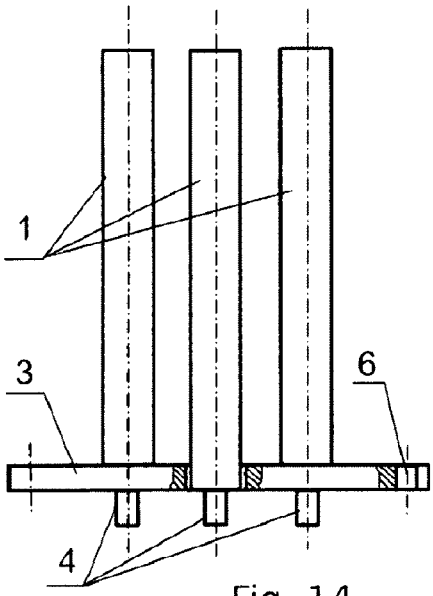
FIG. 14 represents a side view of a multiple electrode with electrodes arranged on the basis in parallel.
Figure 15:
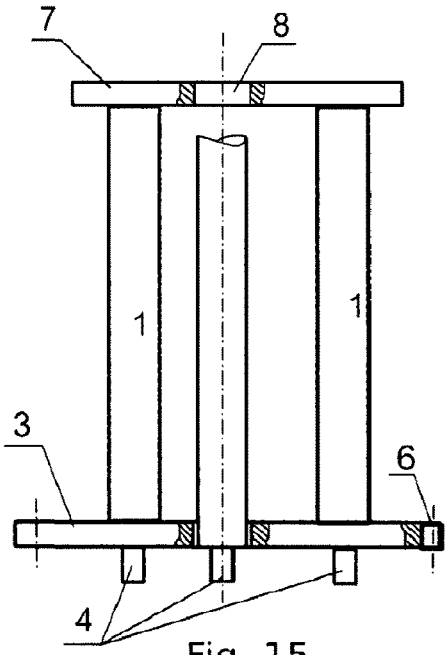
FIG. 15 shows a side view of a multiple electrode with electrodes arranged on the basis in parallel, irregularly and asymmetrically; fixing insulating washer being pressed-in at free electrode ends.

FIG. 14 represents multiple electrode 1, fastened by pressing into electrical insulating basis 3 with open free ends of electrodes 1 to be installed inside case 2 or from outside into case according to FIGS. 1-13. Basis 3 has holes 6 to attach it to case 2. The multiple electrode may have fixing washer 7, FIG. 15, located at the ends of electrodes 1 to lock their initial position against displacement and distortions in dynamic conditions of heating/cooling. Here, electrodes 1 are pressed into fixing washer 7 implemented of electrical insulating heat-resistant material having its coefficient of expansion equal or close to the coefficient of expansion of basis 3. Electrodes 1 are pressed into holes 8 of washer 7 by its full thickness (FIG. 15) or its partial thickness (FIGS. 16-17, 19-20) with pockets being formed. The position of electrodes 1 on basis 3 and thus on washer is asymmetric (FIGS. 15-16, 19-20, 22). Thereat such a fastening of fixing washer 7 allows maintaining of position of electrodes 1 according to FIGS. 1-12 in any operation modes of the device preventing any changes in the current propagation paths, possibility of short-circuit between electrodes, shorting across electrodes, and in its turn improves the efficiency and stability of device operation.

Figure 16:
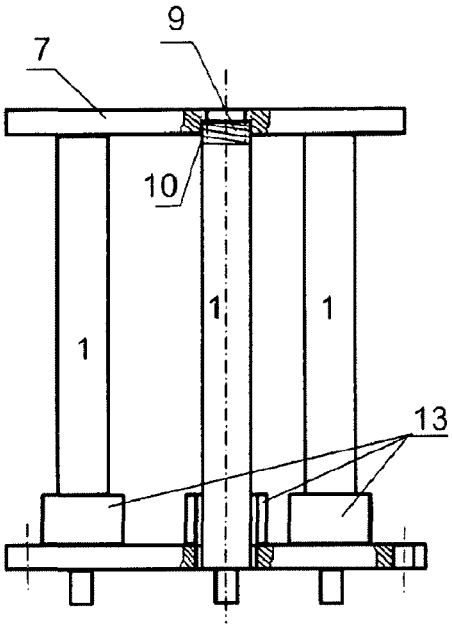
FIG. 16 gives a side view of a multiple electrode with electrodes arranged on the basis in parallel, irregularly and asymmetrically; dielectric bushings being fitted on electrodes at the points of their attaching to the basis and fixing insulating washer connected to free electrode ends by threaded connection.
Figure 17:
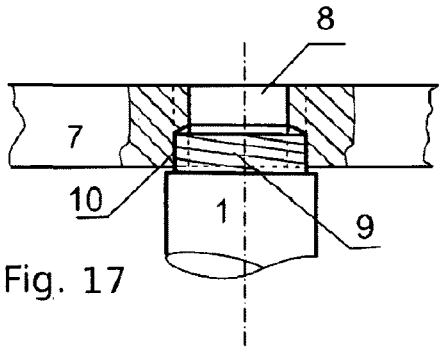
FIGS. 17-18 illustrate sub-embodiments of electrode threaded connection to the fixing insulating washer with pockets formed and in flush.
Figure 18:
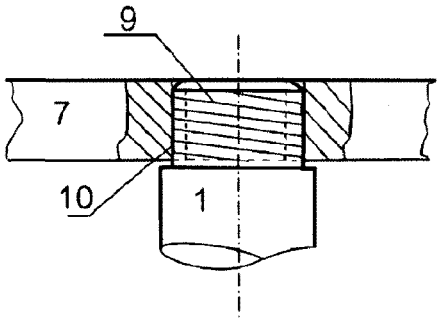

FIGS. 16-18 illustrate a sub-embodiment of fastenning of electrodes 1 in fixing washer 7 by means of thread 9 cut on the outer surface of chamfers 10 of the end of electrode 1 of round cross-section. In this case electrodes 1 are screwed with their ends into washer 7 by partial thickness of washer 7 with pockets being formed—FIG. 17, or by its full thickness—FIG. 18. It is assumed that washer 7 has holes 8 provided with a thread corresponding to thread 9 on chamfers 10 of electrodes 1. This allows an extension of the device variety and increase of its adaptability to actual manufacturing methods. Besides, under certain circumstances this can facilitate device assembly, especially if the noncriticality of electrode screwing by the full thickness of the fixing washer is introduced into the invention.

Figure 21:
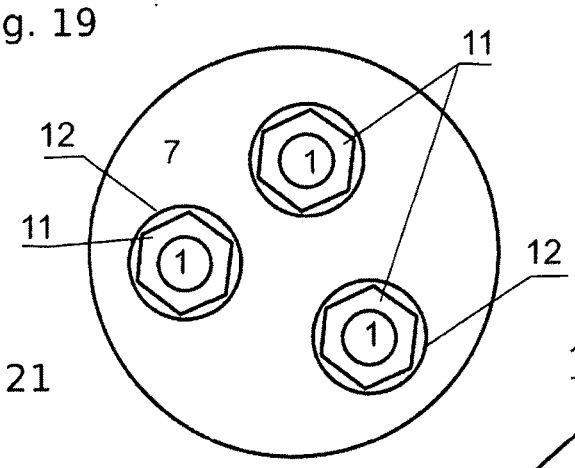
FIGS. 21 . . . 23 represent top views of fixing washers of different shapes in plane.
Figure 22:
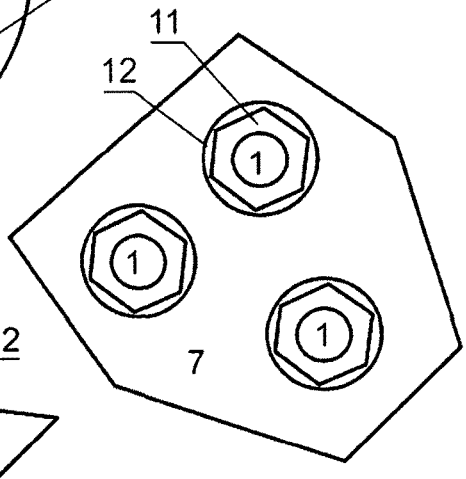
Figure 23:
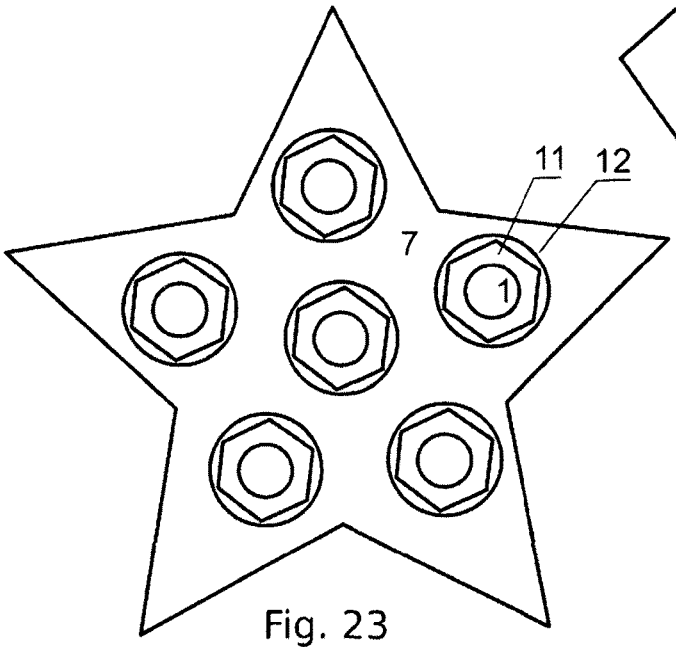
Figure 24:
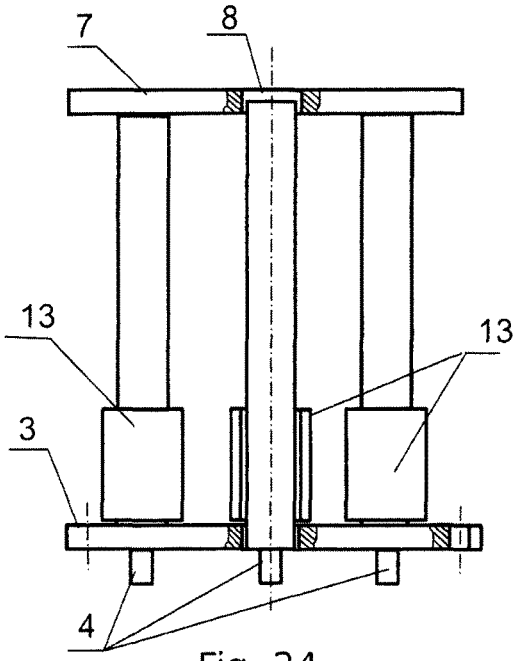
FIGS. 24 . . . 25 give a side view of multiple electrode with dielectric bushings of equal height on electrodes in the first sub-embodiment and of reduced height in the second sub-embodiment; free electrode ends being pressed-in with pockets formed in the fixing washer.
Figure 25:
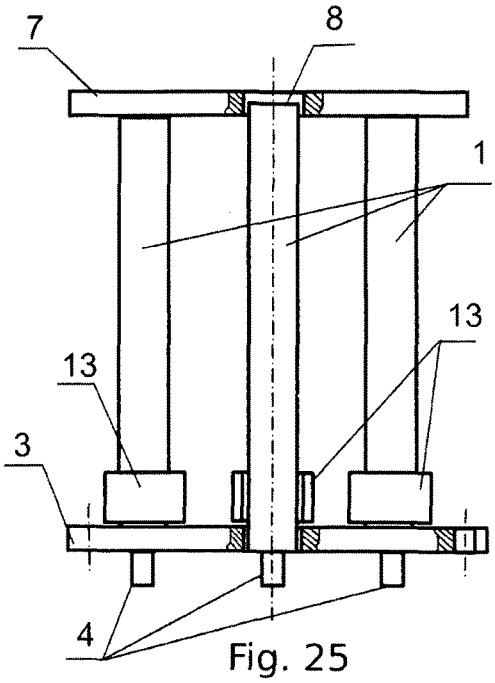

FIGS. 19-23 show sub-embodiments of fastening of washer 7 at the ends of electrodes 1 by means of nuts 11 to be installed in pockets 12 of washer 7. In this case chamfers 10 of free ends of electrodes 1 are implemented of round cross-section and of diameter allowing their easy coming into washer holes 8 implemented as threadless. After washer 7 is installed at the ends of electrodes 1, nuts 11 are screwed until tight into the bottom of pockets of washer 7, this resulting in nuts 11 not protruding from the surface of washer 7. Washer 7 in plane may have the shape of a circle, ellipse, polygon, star, etc. (FIGS. 21-23).

FIGS. 24-28 represent sub-embodiments of a device comprising all the above named attributes as related to the electrode arrangement and implementation as claimed in the above embodiments in various combinations, which additionally comprise bushings 13 implemented of electrical insulating heat-resistant material. Bushings 13 are made as cylindrical segments which internal cross-section in its shape replicates approximately or accurately the cross-section of electrodes 1. Bushings 13 are superposed on electrodes 1 so that one butt of each bushing 13 rests against basis 3—FIGS. 19, 24, 25.

Figure 19:
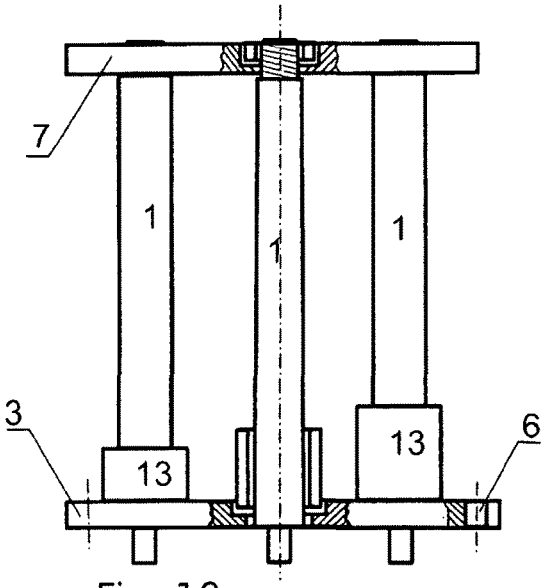
FIG. 19 gives a side view of a multiple electrode with dielectric bushings of different heights on electrodes and a sub-embodiment of electrode threaded connection to the fixing washer by means of nuts flushed in the fixing washer.
Figure 20:
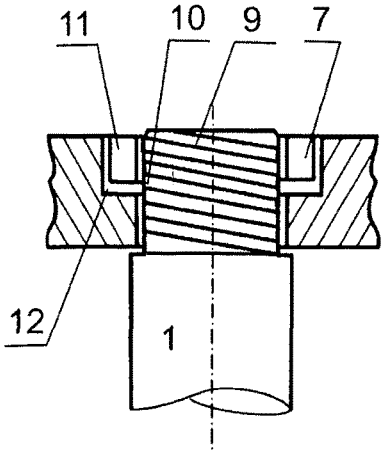
FIG. 20 shows a view of the said connection.
Figure 26:
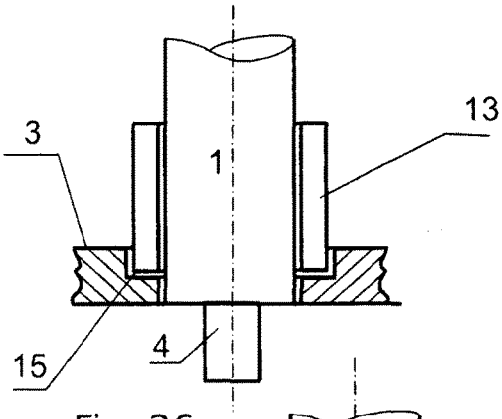
FIGS. 26 . . . 27 give a side view of multiple electrode with dielectric bushings of different heights on electrodes, sunk into the groove around electrodes.
Figure 27:
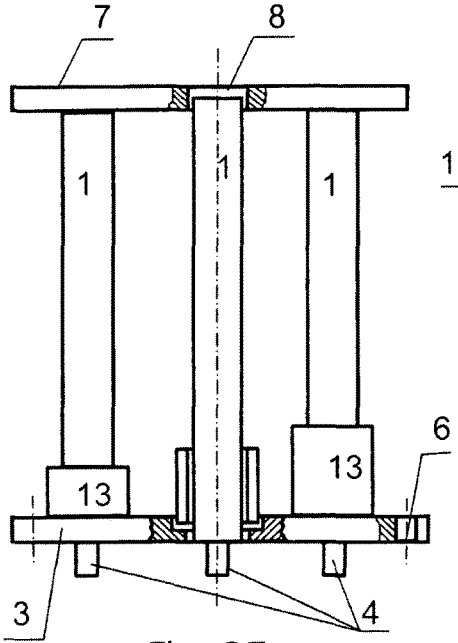
Figure 28:
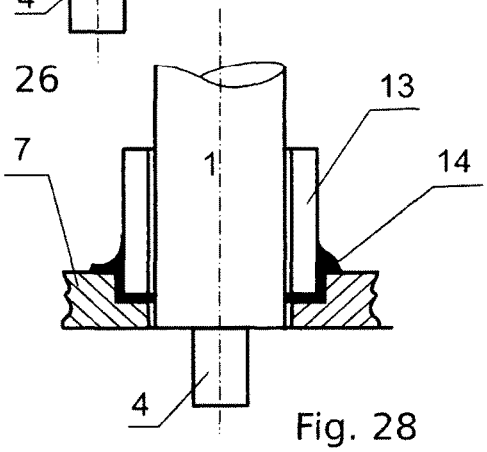
FIG. 28 shows a view of electrode dielectric bushing connection to the basis; the joint being sealed.

The height of bushings 13 in sub-embodiments of Embodiment 1 may be equal for all electrodes 1 (FIGS. 24, 25) or different (FIGS. 19, 26). The boiler capacity can be controlled over a wide range by a simultaneous increase or reduction in the height of bushings 13, without any changes made to the design, number, and arrangement of electrodes. Changing the height of bushings 13 at various electrodes 1 individually and independently, as shown in FIGS. 19, 27, one can control not only the total capacity but loading for each phase as well in the case of multiple (three-) phasing In the case of sub-embodiments (FIGS. 19, 26-28) of the device within Embodiment 1, bushings 13 may be installed directly on basis 3 and secured, for instance, with sealant 14. They also may be installed in circular groove 15 on basis 3 around electrodes 1 implemented to the cross-sectional shape of bushing 13 and secured with seal 14 as well, FIG. 28. In addition, bushings 13, especially as secured with sealant 14, allow a reduction or even prevention of the probability of a breakdown between electrodes 1, along the surface of basis 3 including after a period of operation in the case of gradual deposition of foreign particles, sludge on it.

Embodiment 2

FIGS. 8-28 represent a view of electrode boiler with multiple electrode configuration according to Embodiment 2 of the invention in question. Embodiment 2 has the following specific aspects as compared to Embodiment 1.

Figure 8:
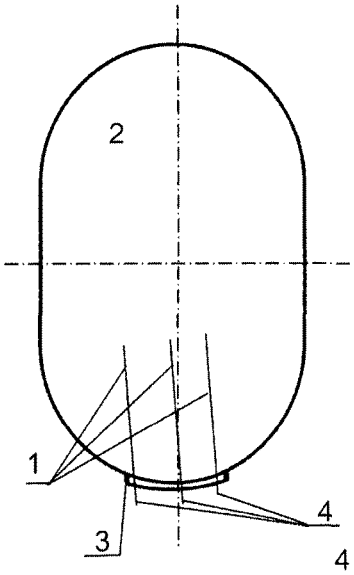
FIGS. 8 . . . 13 show a schematic of electrodes arrangement on the basis similar to FIGS. 1 . . . 7 with electrodes arranged inside the case upwards according to Embodiment 2.
Figure 9:
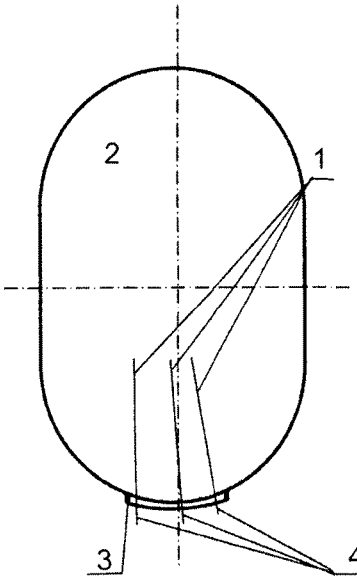

As per Embodiment 2, electrodes 1 of the device, at least one electrode or more, for example two or three for a three-phase electric mains, or in number multiple of 3 for a three-phase electric mains—are directed into case 2 upwards. In FIG. 8 electrodes 1 are directed upwards vertically with the longitudinal axes of all electrodes 1 slightly deviating from the longitudinal symmetric axis of case 2. Electrodes 1, if used in number exceeding one, may be installed at different unequal distances from each other (FIG. 8). The longitudinal axes of electrodes may also make non-zero angles against each other for all electrodes 2 or a part of them as shown in FIG. 9; this being accompanied with unequal distances between electrodes 1 at the same time. Electrodes 1 are located on basis 3 which similarly to Embodiment 1 may be installed either inside case 2, FIGS. 10-11, or outside it—FIGS. 8-9, 12-13.

Figure 10:
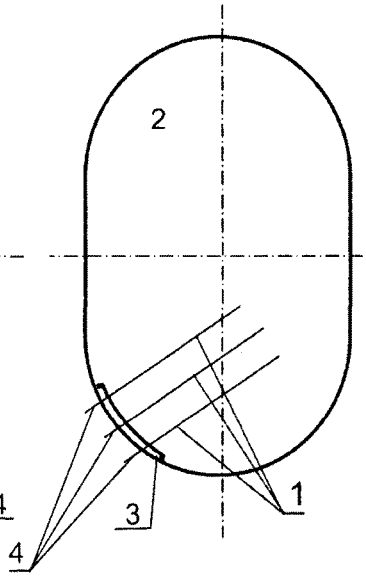
Figure 11:
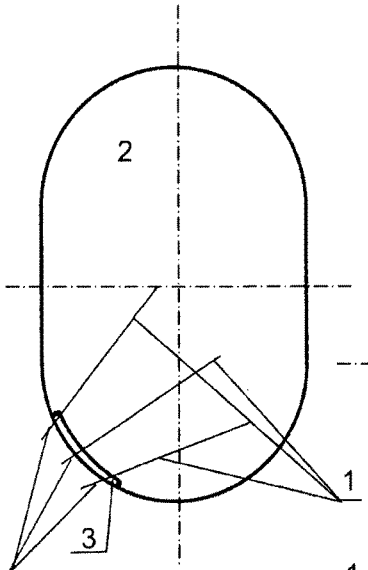

FIGS. 10-11 show the electrode arrangement with large angles of deviation from the longitudinal symmetric axis, notably the entry of electrodes 1 upwards at the side of boiler case 2, this accompanied with an irregular asymmetric arrangement of electrodes with respect to each other, i.e., with different distances between their points of entry to case 2 and different angles between the longitudinal axes of electrodes 3, FIG. 11.

Figure 12:
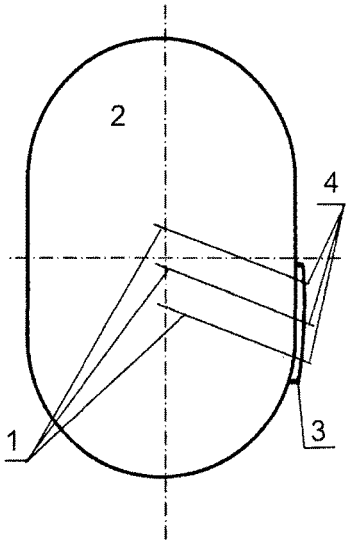

FIGS. 12-13 illustrate the arrangement of electrodes 1 on the side surface of case 2, their longitudinal axes deviating from the case symmetric axes and from each other (FIG. 13), and electrode ends being directed into the upper part of case 2. In this case as well as in other sub-embodiments basis 3 may be secured either inside case 2 or outside it.

Such an implementation of electrode arrangement allows considering of specific design features of some boiler types, simplifying their manufacturing processes, routine maintenance, and repairs. Besides, this provides opportunities of boiler convection improvement and enhancement of its efficiency in static operation conditions.

Specific aspects of concrete embodiment of electrode 1 or a multiple electrode comprising several electrodes 1 coincide with Embodiment 1 as shown in FIGS. 14-28.

Embodiment 3

FIGS. 29-36 represent a view of configuration of an electrode boiler with multiple electrode according to Embodiment 3 of this invention. Embodiment 3 has the following specific aspects as compared to Embodiments 1 and 2.

As per Embodiment 2, electrodes 1 of the device, at least one electrode or more, for example two or three for a three-phase electric mains, or in number multiple of 3 for a three-phase electric mains, or in any required number, generally all used in a concrete specimen of the device, are fastened directly in case 2 without any basis. Such an implementation of the device provides (FIG. 29) fastening of electrodes 1 through dielectric insulating heat-resistant inserts 5 directly pressed into the wall of case 2 or its cover. Here, terminals 4 of electrodes 1 for connection of an electric power supply are brought outside from the device case 2.

Electrodes 1 may be grouped at the same point of boiler case similarly to Embodiments 1, 2 or distributed on the inner surface of case 2 as required to meet the specific problem of the device. The implementation of electrodes fastening in case 2 as claimed by this Embodiment, directly without intermediate basis, allows not to bind electrodes 1 into a multiple electrode, this technologically simplifying the distribution of their fastening over the case surface and thus over the internal space of the boiler. This expands the functionality and assortment range of the device embodiments, enhances its versatility, and increases the range of concrete tasks to be met.

In the Embodiment in question, FIGS. 30-36, any combinations of arrangement of any number of electrodes 1 are possible, with electrodes deviating from the boiler symmetric axes and from the strict regularity of their location to a variable degree, with any slope angles with respect to each other. The possibility of such an asymmetry in the arrangement of electrodes 1 and its variation is not found to be mentioned in any literary sources and considerably simplifies the fabrication technique and repair of the device and reduces their cost; it also bates the safety requirements in maintenance of the device, in particular as to its cleaning and desludging. The ample opportunities of the variety of asymmetric fastening of electrodes 1 allow a better selection of their optimum arrangement and organization to the best advantage of boiler convection process subject to the case configuration, specific designation, and design of the boiler. This also enables planning and controlling the asymmetry in the processes of sludge deposition on components of the electrode system allowing introducing a non-uniformity into the decrease of boiler efficient operation within intervals between scheduled cleanings, this making it possible to increase its efficiency.

The operation of boiler in all its embodiments is as follows.

The boiler can be used as self-contained or its case 2 is built-in into an open or circulating water heating system at any required point. The heating system is filled with water treated in usual manner with its resistance brought, and electrodes 1 of boiler are connected by means of terminals 4 arranged outside its case 2 to an external single-phase or three-phase electrical circuit. Cooled water from heating radiators is supplied into boiler case 2 where it is heated by electric current passing through it between electrodes 1. The heated water from case 2 is supplied to consumers, heating radiators, for example. Convection processes occurring in boiler case 2 during water heating between electrodes 1 can be purposefully organized by the mutual orientation and arrangement of electrodes so that the boiler can be operated as a circulating pump without any forced water pumping in the closed system. This is considerably contributed by the provided in present invention manner of mutual orientation, possibility of an asymmetric arrangement of electrodes inside the case and relative to each other. In addition, this allows a redistribution of sludge formation processes inclusive of those at electrodes themselves. The electrode arrangement as provided by this invention makes it possible to select the current passage paths and vary the current-density distribution thus enabling an optimization of boiler operation both in static and dynamic conditions.

The invention claimed is:

1. Electrode boiler with electrodes unit comprising:

a) a case;

b) multiple electrode in the form of fastened inside the case rod electrodes, at least one;

and the electrodes shall be arranged non-symmetrically relative to the case symmetric axes and to each other;

and electrode longitudinal axes not coinciding with the case longitudinal axes;

and electrode longitudinal axes not coinciding with the case transverse axes;

and electrodes having external terminals brought out from the case outside.

2. Electrode boiler with electrodes unit according to claim 1, the multiple electrode shall also comprise at least one electrode basis.

3. Electrode boiler with electrodes unit according to claim 2, besides, the electrode boiler basis shall be implemented in the form of a plate, a) electrodes being fastened to the plate, and electrodes are fixed on one side of its first surface so that their longitudinal axes are arranged in the direction close to the normal one with respect to the first plate surface;

b) electrode basis being fastened with the second surface on the inner side of the case.

4. Electrode boiler with electrodes unit according to claim 2, the basis may be implemented of electrically insulating heat-resistant material.

5. Electrode boiler with electrodes unit according to claim 2, the electrode basis may be implemented of metal.

6. Electrode boiler with electrodes unit according to claim 3, the electrode basis is fastened with the second plane on the inner case side so that electrode ends are directed inside the internal boiler space.

7. Electrode boiler with electrodes unit according to claim 6, the electrode basis is fastened with the second plane on the inner side of the upper half-case so that electrode ends are directed inside the internal boiler space downwards.

8. Electrode boiler with electrodes unit according to claim 6, the electrode basis is fastened with the second plane on the inner side of the upper half-case so that free electrode ends are directed inside the internal boiler space laterally.

9. Electrode boiler with electrodes unit according to claim 6, the electrode basis is fastened with its second plane on the inner side of the lower half-case so that free electrode ends are directed inside the internal boiler space upwards.

10. Electrode boiler with electrodes unit according to claim 3, the electrode basis is fastened with one its plane on the outer case side so that electrode ends are directed inside the internal boiler space.

11. Electrode boiler with electrodes unit according to claim 10, the electrode basis is fastened with the first plane on the outer side of the upper half-case so that electrode ends are directed inside the internal boiler space downwards.

12. Electrode boiler with electrodes unit according to claim 10, the electrode basis is fastened with the first plane on the outer side of the upper half-case so that free electrode ends are directed inside the internal boiler space laterally.

13. Electrode boiler with electrodes unit according to claim 10, the electrode basis is fastened with its first plane on the outer side of the lower half-case so that free electrode ends are directed inside the internal boiler space upwards.

14. Electrode boiler with electrodes unit according to claim 3, containing:

a) besides, the electrode boiler comprises insulating bushings implemented in the form of cylindrical tubes, superposed on the first electrode ends and connected to the basis until they rest in the basis;

b) the bushings being constructively sunk, at least partially, in the basis;

c) the height of bushings may vary.

15. Electrode boiler with electrodes unit according to claim 14, which the height of bushings may vary equally for all the electrodes.

16. Electrode boiler with electrodes unit according to claim 14, which the height of bushings may vary individually for each electrode.

17. Electrode boiler with electrodes unit according to claim 14, which silicon joint sealant is applied between the basis and bushings at the interfaces.

18. Electrode boiler with electrodes unit according to claim 14, which:

a) in the electrode boiler with multiple electrode the boiler case is used as the electrode basis as well;

b) bushings being inserted into through holes of the case so that they seal and insulate the case from the electrodes;

c) electrode ends are brought through the bushings outside from the case, bushings being electric terminals.

19. Electrode boiler with electrodes unit according to claim 18, which besides, in the electrode boiler with multiple electrode, free electrode ends are directed inside the boiler.

20. Electrode boiler with electrodes unit according to claim 2, comprising the electrode boiler with multiple electrode also comprises a fixing element implemented in the form of at least one washer having holes through which free electrode ends are brought.

21. Electrode boiler with electrodes unit according to claim 20, which electrodes are pressed in the fixing element at least by a partial depth of the fixing element.

22. Electrode boiler with electrodes unit according to claim 20, comprises the following:

a) chamfers made on the second electrode ends, which diameter corresponds to the diameter of washer holes;

b) screw thread on the chamfers of second electrode ends; electrodes being screwed with their threaded parts into the washer holes, at least by the third part of washer thickness;

c) nuts being fitted on the threaded electrode parts after the washer on the side of second electrode ends;

and the washer resting against electrode shoulders formed by the chamfers and being tightly pressed by nuts.

23. Electrode boiler with electrodes unit according to claim 21, comprising the electrode boiler with multiple electrode also comprises the following: pockets made on washer surfaces, their centre coinciding with the hole centres.

24. Electrode boiler with electrodes unit according to claim 23, which a) the pocket depth corresponds to the nut height;

and the nuts screwed on electrode ends being arranged in the pockets in flush.

25. Electrode boiler with electrodes unit according to claim 22, which the nuts are made of electric insulating material.

26. Electrode boiler with electrodes unit according to claim 22, which the nuts are made of heat-resistant material.

27. Electrode boiler with electrodes unit according to claim 22, which the nuts are made of metal.

28. Electrode boiler with electrodes unit according to claim 22, which:

a) there is also an electrode boiler with multiple electrode in which: expansion coefficient of washer material corresponds to the expansion coefficient of basis material;

b) expansion coefficient of nut material corresponds to the expansion coefficient of washer material.

* * * * *